United States Patent [19]

Cassells

[11] 4,293,154

[45] Oct. 6, 1981

[54] SAFETY LOCK FOR WINDOW SASHES AND THE LIKE

[76] Inventor: Melvin K. Cassells, 67 Vinehill Rd., Elmwood, Conn. 06110

[21] Appl. No.: 79,793

[22] Filed: Sep. 28, 1979

[51] Int. Cl.[3] ..... E05C 1/04

[52] U.S. Cl. ..... 292/144; 292/DIG. 47; 292/152

[58] Field of Search ..... 292/144, 152, DIG. 47, 292/DIG. 46, 288, 147, 145

[56] References Cited

U.S. PATENT DOCUMENTS

| | | | |
|---|---|---|---|
| 1,191,502 | 7/1916 | Emme | 292/152 X |
| 1,236,618 | 8/1917 | Stagman | 292/152 X |
| 2,497,697 | 2/1950 | Smith | 292/144 X |
| 2,546,149 | 3/1951 | Bowzer | 292/150 X |
| 3,078,704 | 2/1963 | Rifkin | 292/144 X |
| 3,475,720 | 10/1969 | Culver | 339/217 S |
| 3,642,315 | 2/1972 | Alpern | 292/144 |

*Primary Examiner*—Richard E. Moore

*Attorney, Agent, or Firm*—Prutzman, Kalb, Chilton & Alix

[57] ABSTRACT

A safety lock for window sashes and the like is provided which comprises a bolt and a locking and mounting sleeve adapted to be inserted in a drilled hole in the sash or other member to be interlocked, the sleeve and bolt being provided with detent means for releasably retaining the bolt in fully inserted locked position, a partially inserted locked position and in retracted unlocked position. The bolt has an enlarged head of substantially the same diameter as the sleeve and the sleeve is recessed in the drilled hole so that the head of the bolt lies flush with the outer surface of the sash or other member where it is inconspicuous and cannot be grasped for withdrawal, withdrawal from fully locked to partially inserted locked position requiring the use of a magnet. A modification of the end of the sleeve may be utilized for attaching the sleeve to the outer wall of a sash or other unit having a hollow interior.

8 Claims, 6 Drawing Figures

SAFETY LOCK FOR WINDOW SASHES AND THE LIKE

My invention relates to protective devices and, more specifically, to an improved locking device and mode of operation having particular usefulness for interlocking the upper and lower sashes of a double hung window unit to protect against theft or vandalism or any other kind of unauthorized entry.

Window locks of various types have been proposed heretofore, but many of them are defective or unsafe under normal conditions of use. For example, a typical way of forcing an illegal entry is to pry up the lower sash with a conventional pry-bar which can easily create a force of a half ton or more. Tests have shown that only sufficiently rugged interlocking bolt type devices which operate in shear are able to withstand such pressures. Accordingly, bolt type locks have been proposed for this purpose but even they have serious disadvantages if an intruder can cut or break away a portion of the glass sufficient to insert a hand and then manually disengage the bolt. To prevent this, locks of the bolt type have been provided with various devices for preventing withdrawal of the bolt operated by special keys or tools. However, this presents a serious safety hazard in that they can impede or prevent a fast emergency exit should the key or special opening tool be misplaced or otherwise unavailable when the emergency occurs. Locks of this type are disclosed, for example, in U.S. Pat. Nos. 1,843,402, 1,992,531, and 2,845,789.

The present invention is intended to overcome the deficiencies of the locking devices of the prior art by providing a strong lock of the sliding bolt type which can assume a fully interlocked position with the head of the bolt flush with the surface of the window sash rendering it inconspicious and difficult to detect either by sight or feel and whereby it cannot be grasped for withdrawal to unlocking position. The bolt is preferably held in locked position by detent means of sufficient strength to keep the bolt firmly seated in locked position and not susceptible to being jiggled or easily pried loose, but sufficiently yieldable so that the bolt can be withdrawn by engaging it with a magnet, preferably a small permanent magnet of a type readily available commercially. The bolt and detent means is also designed to provide an intermediate holding position for the bolt at which position the window sashes are still interlocked but the head end of the bolt protrudes outwardly sufficiently so that it can be grasped between the thumb and fingers and withdrawn manually. This provides a safe locking position to be employed while the building is inhabited in case a quick emergency exit is required. A third or unlocked position of the bolt is also established by the detent means for assuring complete unlocking of the bolt but preventing the bolt from being completely withdrawn from the sash. Other advantages of locks embodying my invention are that they may be produced inexpensively and are simple to install by persons of ordinary skill using ordinary tools and with a minimum of instructions and at the same time, the locks are of rugged and durable construction and foolproof in operation providing a long service life.

For convenience and brevity of description, the safety lock of my invention is disclosed primarily as a lock for interlocking window sashes but it will be appreciated by one skilled in the art that my lock has broader application as, for example, for use with sliding doors, cabinet doors and other closure members where it is desired to interlock two parts that abut or contact each other and which are movable relatively to each other along the plane of contact.

BRIEF DESCRIPTION OF THE DRAWINGS

The details of my invention will be described in connection with the accompanying drawing in which.

DESCRIPTION OF THE PREFERRED EMBODIMENT

Figure 1:
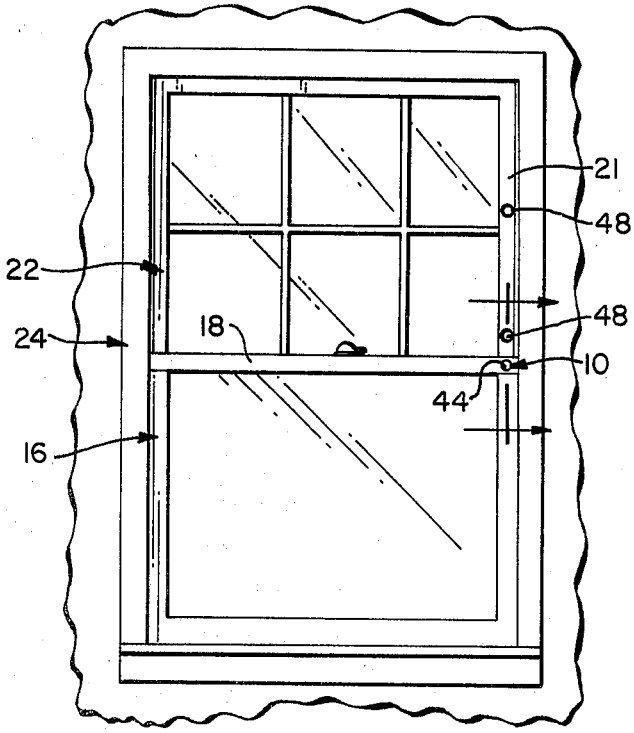
FIG. 1 is a view in front elevation of a window unit having relatively movable sash members in which a lock embodying my invention has been installed.
Figure 5:
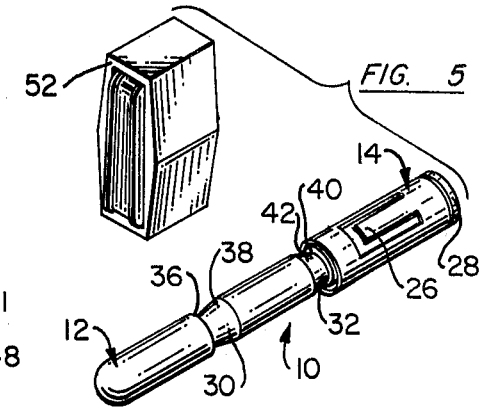
FIG. 5 is a perspective view of the lock assembly and a permanent magnet unit of a type which may be used to operate the bolt.

Referring to the drawing, a lock assembly 10 embodying my invention is shown in perspective in FIG. 5 prior to placement in a window sash or other installation and comprises a bolt 12 and a locking and mounting sleeve 14. In FIG. 1, the lock 10 is shown mounted in the upper right corner of the lower sash unit 16. The placement of the lock 10 may be anywhere desired along the rail 18 of lower sash unit 16 which overlaps the rail 20 of the upper sash unit 22, the sash units 16 and 20 being mounted in the window frame 24 for vertical sliding movement relative to each other.

As shown in FIGS. 2–5, the sleeve 14 is cylindrical in shape and has a pair of integrally formed detents provided by the inwardly directed spring fingers 26 struck in from the wall of the sleeve 14. As will be apparent to one skilled in the art, the form and number of the detents can be varied as desired, but the specific arrangement utilized in the preferred embodiment is found to be advantageous from both an economical standpoint and from the standpoint of good operation.

The bolt 12 is an elongated pin preferably made in one piece of solid metal and having at least its enlarged head 28 made of magnetic material. The preferred material for the pin is hardened steel with a surface which is preferably electroplated or otherwise treated for protection against corrosion. The bolt 12 is preferably made sufficiently smaller in diameter than the inner diameter of the sleeve 14 so that it will easily slide therethrough except for the drag caused by engagement with the spring fingers 26. The head 34 is enlarged to substantially the same diameter as the outside diameter of the sleeve 14 so that it will abut against the edge of the sleeve when the bolt is fully inserted.

It is not intended to limit the invention to a lock assembly of any specific dimensions or measurements as it will be apparent that that this may be varied in accordance with the requirements of the specific installation. However, it may be noted that for use with ordinary conventional window sashes it has been found that a steel bolt 12 having a diameter of about ¼ inch will have adequate strength and can be used with a sleeve 14 having an outside diameter dimensioned to provide a force fit when inserted in a hole made in a wooden sash with a 5/16th inch diameter drill bit. In the preferred embodiment, the bolt 12 is slightly more than three times as long as the sleeve 14 and for such conventional wooden sashes, the bolt 12 is preferably made approximately 2½ inches in length while a sleeve 14 having a length of about ¾ inch is ample.

The bolt 12 is provided with two longitudinally spaced apart circumferential grooves 30 and 32. Groove 30 is spaced inwardly from the rounded inner end 34 of the bolt 12 a distance approximately equal to one third the length of the bolt and is preferably formed with an outer vertical shoulder 36 and an inner sloping shoulder 38. Groove 32 is spaced away from the head 28 a distance also approximately equal to one third the length of the bolt and it preferably has a vertical shoulder 40 and an inner sloping shoulder 42.

To install the lock assembly 10 for interlocking window sashes, for example, in the fully closed position as shown in FIG. 1, the sash units 16 and 22 are first placed in the selected closed position and then a hole 44 is drilled inwardly through the rail 18 of the lower sash unit 16 following which the drilling is then continued into the rail 20 of the upper sash unit 22 to form an alined hole 46, the drilling being stopped when the combined depth of the two holes is slightly longer than the bolt 12. In the specific example referred to previously, a combined hole depth of approximately 2¾ inches would be required. The diameter of the drill used is one that will afford a force fit when the sleeve 14 is inserted. If it is desired to be able to interlock the sash units 16 and 22 in various partially opened positions, additional holes 48 may be drilled in the rail 21 of the upper sash unit 22 as shown in FIG. 1 of the drawings. If desired, eyelet type grommets 50 may be inserted into the openings of the holes 46 and 48 for enhanced appearance and to minimize wear.

After the holes 44 and 46 have been drilled, the lock assembly 10 is mounted in the rail 16 by inserting the rounded end 12 of the bolt 12 into the hole 44 and then pressing inwardly on the head 28 of the bolt until it is flush with the outer surface of the rail 18 driving the sleeve 14 ahead of it into the hole 44. Because of the tight fit of the sleeve 14 in the hole 44 it may be necessary to use a striking implement to obtain flush seating of the head 28 as it drives the sleeve 14 ahead of it into the interior of the hole 44.

Figure 2:
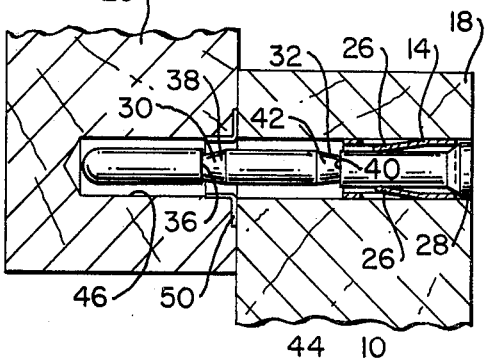
FIG. 2 is a fragmentary cross-sectional view taken along the line 2—2 of FIG. 1 with the lock in fully locked position.
Figure 3:
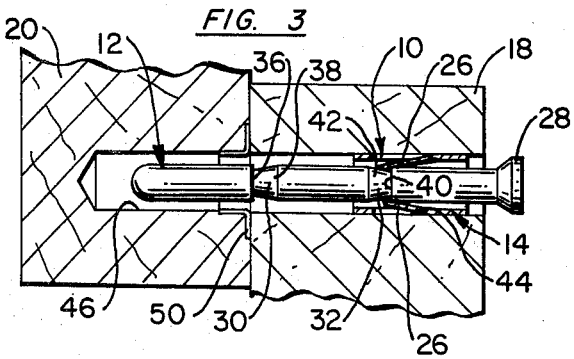
FIG. 3 is a view similar to FIG. 2 in which the bolt has been partially retracted to an intermediate locking position.

The operation of the lock assembly 10 of my invention should be apparent from the foregoing description taken together with the following explanation. When the lock assembly 10 is mounted in the rail 18 and the bolt is pressed inwardly so that the head 28 is flush with the surface of the rail 18 as described, the window sash units 16 and 22 are in a fully interlocked position as shown in FIG. 2. In this position, the bolt 12 cannot be grasped or engaged in any way to cause it to be withdrawn from fully locked position. However, by taking a permanent magnet such as the magnet 52 shown in FIG. 5 and touching it to the head 28 of the bolt 12, sufficient force can be transmitted manually to withdraw the bolt 12 to the partially withdrawn locked position shown in FIG. 3 or the fully withdrawn unlocked position shown in FIG. 4, the withdrawal of the bolt 12 being resisted only by the pressure of the spring fingers 26 against the side of the bolt 12. It has been found that small permanent magnets 52 of the type which are commercially available for use in magnetic latches and the like will provide adequate magnetic force to adhere to the head 28 of the bolt 12 sufficiently to enable the user to pull out the bolt to at least the partially withdrawn locked position shown in FIG. 3 where, of course, the head 28 of the bolt can be grasped between the thumb and fingers as shown in phantom in FIG. 4.

For optimum protection against theft or the like, the bolt 12 of the lock assembly 10 is placed in the fully inserted locked position shown in FIG. 2 in which the lock is least noticeable and from which position the only way to unlock the assembly is by means of a magnet as previously described. However, thwn the building is occupied, it may be preferred to set the lock assembly with the bolt 12 in the partially withdrawn locked position shown in FIG. 3, wherein the bolt 12 is partially withdrawn but still has a substantial portion extending into the hole 46 and interlocking the two sashes. This position is easily ascertained because of the ends of the spring fingers 14 are then engaged in the groove 32. In this position, in case of an emergency, the head of the bolt 12 can be easily grasped manually and the bolt can be pulled out to fully unlocked position even though the magnet is misplaced or otherwide unavailable. In the fully unlocked position, the inner ends of the spring fingers 26 abut against the vertical shoulder 36 of groove 30 preventing further withdrawal or removal of the bolt 12.

Figure 6:
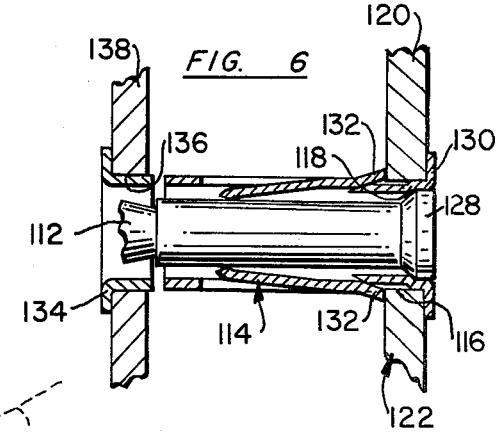
FIG. 6 is a fragmentary cross-sectional view showing a modified version of the lock mounted in a metal sash of the hollow core type.
Figure 4:
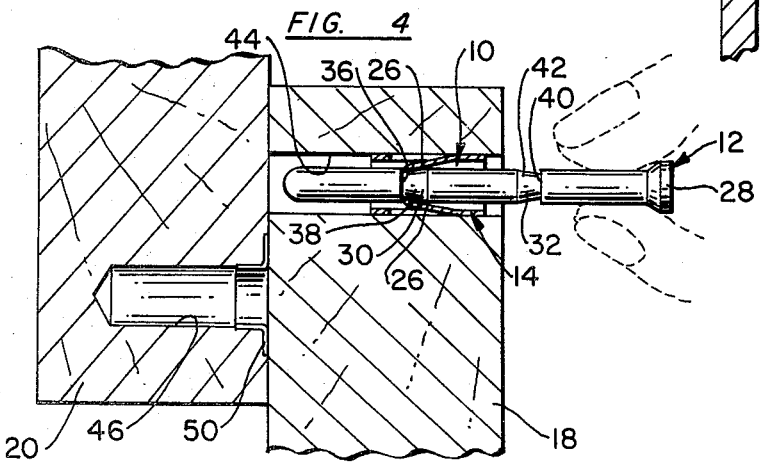
FIG. 4 is a view similar to FIGS. 2 and 3 with the bolt fully retracted to unlocked position and with the sash rails moved away from the previously interlocked position.

FIG. 6 of the drawing shows a modification of a lock assembly enabling it to be mounted in metal sash units of the hollow core type. In this modification a sleeve 114 is provided which is similar to the sleeve 14 except that it has an outer extension 118 for engagement in a hole 116 in the outer wall 120 of the lower sash unit 122. The extension 118 is of enlarged diameter so as to accommodate the head 128 of the bolt 112 and terminates in a flange 130 for engaging around the outer periphery of the hole 116. Resilient ears 132 are struck up from the wall of the sleeve 114 so as to engage against the inner surface of the wall around the periphery of the hole 116 when the sleeve 114 is fully inserted thereby securely mounting the sleeve 114 on the wall 120. In order to guide the inner end of the bolt 112, an elongated grommet 134 is inserted in and alined hole 136 in the rear wall 138. The operation of the lock assembly is the same as in the first embodiment.

In accordance with the invention, a strong and secure lock of simple and inexpensive construction and easy to install has been provided for use with window sashes and the like which in the fully locked position is easy to detect and resistant to opening except by use of a magnet, but which can be set in a partially locked position if desired when the building is occupied thereby permitting easy manual opening in case of emergency. As will be apparent to persons skilled in the art, various modifications, adaptations and variations of the foregoing specific disclosure may be made without departing from the teachings of the present invention.

I claim:

1. In combination, a pair of relatively movable members having a selected position in which portions of said members overlap, a safety lock for preventing relative movement of said members away from said selected position comprising a cylindrical sleeve, an elongated bolt of greater length than the sleeve slidably received in the sleeve, an enlarged head at one end of the bolt adapted to abut against one end of the sleeve and having substantially the same outer diameter as the sleeve, one of said positions which overlap at the selected position of the members having a through hole registering with a mating hole partially extending through the other of said portions, said sleeve having a press fit with the said through hole and being of shorter length than the drilled hole and being positioned in the hole with its outer end spaced inwardly from the outer surface of the member surrounding the periphery of the hole with the head of the bolt substantially flush with said outer surface, said bolt being of sufficient length to extend into the mating hole when the head of the bolt is flush with said outer surface and also when the bolt is partially withdrawn sufficiently to permit the head of the bolt to be grasped manually, and detent means operative between the sleeve and bolt for yieldably retaining the bolt in a fully inserted locking position in the sleeve, a partially withdrawn locking position in the sleeve, and a further withdrawn unlocking position.

2. The combination defined in claim 1 wherein the detent means comprises at least one inwardly extending spring finger on the sleeve and a pair of longitudinally spaced apart peripheral grooves in the bolt.

3. The combination defined in claim 1 wherein the member having the through opening is hollow and has an outer wall, and the sleeve is provided with an outer extension of enlarged diameter and a peripheral flange for mounting the sleeve in cantilever fashion in the hollow member with the extension and flange secured to the outer wall of the hollow member.

4. The combination defined in claim 2 wherein the sleeve is a metal sleeve and the spring fingers are struck inwardly from the peripheral wall of the sleeve.

5. The combination defined in claim 2 wherein the bolt is of the order of three times the length of the sleeve and the two grooves are equally spaced between the ends of the bolt.

6. The combination defined in claim 1 or 2 having in combination therewith a portable permanent magnet adapted to be hand held and placed against the head of the bolt to enable the bolt to be manually withdrawn from its fully inserted locking position in the sleeve.

7. In a window unit of the type comprising relatively movable upper and lower window sashes having rails which overlap when the window unit is closed, the rail of the lower window sash having a through hole and the rail of the upper window sash having a mating hole extending partially therethrough and disposed opposite the through hole of the lower window sash, the combination therewith of a safety lock comprising a sleeve fixed in the through hole, an elongated bolt slidably mounted in the sleeve and having a head dimensioned to fit into the outer end of the said through hole with its outer surface flush with the outer surface of the rail of the lower window sash, said bolt being sufficiently elongated to extend into the mating hole of the upper window sash when the bolt is in fully inserted position when the head of the bolt is flush with the said outer surface of the rail and also when the bolt is in a partially withdrawn position with the head portion of the bolt exposed so that it can be grasped manually, and means for releasably holding the bolt selectively in said positions.

8. The combination set forth in claim 7 together with a portable permanent magnet adapted to be hand held and placed against the head of the bolt to enable the bolt to be manually withdrawn from the said fully inserted position.

* * * * *